US009303428B1

(12) United States Patent
Wu

(10) Patent No.: US 9,303,428 B1
(45) Date of Patent: Apr. 5, 2016

(54) TENT WITH A REINFORCED FRAME-SUPPORTING STRUCTURE

(71) Applicant: Guoxiang Wu, Ningbo (CN)

(72) Inventor: Guoxiang Wu, Ningbo (CN)

( * ) Notice: Subject to any disclaimer, the term of this patent is extended or adjusted under 35 U.S.C. 154(b) by 0 days.

(21) Appl. No.: 14/602,521

(22) Filed: Jan. 22, 2015

(30) Foreign Application Priority Data

Sep. 26, 2014 (CN) ..... 2014 2 0560626 U

(51) Int. Cl.
*E04H 15/50* (2006.01)

(52) U.S. Cl.
CPC ..... *E04H 15/50* (2013.01)

(58) Field of Classification Search
CPC ..... E04H 15/46; E04H 15/50
USPC ..... 135/131, 135, 145, 147, 159, 160
See application file for complete search history.

(56) References Cited

U.S. PATENT DOCUMENTS

| | | | | |
|---|---|---|---|---|
| 2,137,625 | A * | 11/1938 | Norvell | 135/147 |
| 2,723,673 | A * | 11/1955 | Call | 135/140 |
| 4,558,713 | A * | 12/1985 | Hagler et al. | 135/159 |
| 4,779,635 | A * | 10/1988 | Lynch | 135/97 |
| 5,634,483 | A * | 6/1997 | Gwin | 135/131 |
| 5,638,853 | A * | 6/1997 | Tsai | 135/145 |
| 6,598,614 | B2 * | 7/2003 | Liu | 135/131 |
| 6,708,707 | B2 * | 3/2004 | Dotterweich et al. | 135/131 |
| 6,874,519 | B2 * | 4/2005 | Chiang | 135/131 |
| 7,178,542 | B2 * | 2/2007 | Carter | 135/145 |
| 7,360,549 | B2 * | 4/2008 | Seo | 135/145 |
| 7,367,348 | B2 * | 5/2008 | Tsai et al. | 135/145 |
| 7,836,908 | B2 * | 11/2010 | Sy-Facunda | 135/145 |
| 8,590,553 | B2 * | 11/2013 | Lovley, II | E04H 15/46 135/120.2 |
| 2003/0024563 | A1 * | 2/2003 | Liu | 135/131 |
| 2003/0029490 | A1 * | 2/2003 | Price et al. | 135/131 |
| 2003/0172966 | A1 * | 9/2003 | Dotterweich et al. | 135/131 |
| 2003/0213513 | A1 * | 11/2003 | Eriksen et al. | 135/131 |
| 2004/0050412 | A1 * | 3/2004 | Dotterweich | 135/131 |
| 2004/0084074 | A1 * | 5/2004 | Chiu et al. | 135/131 |
| 2004/0144414 | A1 * | 7/2004 | Seo | 135/131 |
| 2004/0250847 | A1 * | 12/2004 | Chiang | 135/131 |
| 2004/0255997 | A1 * | 12/2004 | Seo | 135/131 |
| 2004/0261828 | A1 * | 12/2004 | Jang | 135/131 |
| 2005/0028856 | A1 * | 2/2005 | Seo | 135/131 |
| 2005/0055892 | A1 * | 3/2005 | Tsai | 52/79.1 |
| 2005/0155637 | A1 * | 7/2005 | Kim | 135/131 |
| 2006/0174928 | A1 * | 8/2006 | Choi | E04H 15/58 135/145 |
| 2006/0174929 | A1 * | 8/2006 | Tseng | 135/159 |
| 2008/0066795 | A1 * | 3/2008 | Sy-Facunda | 135/145 |

(Continued)

FOREIGN PATENT DOCUMENTS

| | | | | |
|---|---|---|---|---|
| EP | 534843 | A1 * | 3/1993 | E04H 15/48 |

*Primary Examiner* — Robert Canfield

(57) ABSTRACT

A tent with a reinforced frame-supporting structure is provided, comprising a top disc (1), a plurality of vertex angle support bars (2) whose tops are circumferentially and obliquely connected with the top disc (1), foot bar supports (3) connected with the bottom of each vertex angle support bar (2), hinged beams (4) arranged between two adjacent vertex angle support bars (2), wherein either end of the hinged beams (4) is connected with the upper end of adjacent foot bar supports (3) respectively, a frame-reinforcing support bar (5) is provided between the hinged beam (4) and the top disc (1) whose top is obliquely connected with the top disc (1) and bottom is connected with the middle hinged portion of the hinged beam (4). The tent has the advantages of reinforced-frame structure, increased-hinge stability and prevention of water accumulation in the middle of the inclined plane of the top fabric.

3 Claims, 3 Drawing Sheets

(56) References Cited

U.S. PATENT DOCUMENTS

| | | | | |
|---|---|---|---|---|
| 2008/0078433 | A1* | 4/2008 | Jang | 135/147 |
| 2008/0087313 | A1* | 4/2008 | Jang | 135/145 |
| 2008/0289675 | A1* | 11/2008 | Mallookis et al. | 135/145 |
| 2009/0038666 | A1* | 2/2009 | Carter | 135/145 |
| 2011/0023924 | A1* | 2/2011 | Park | 135/135 |
| 2011/0073148 | A1* | 3/2011 | Choi | 135/145 |
| 2013/0284225 | A1* | 10/2013 | Holland et al. | 135/139 |
| 2014/0116488 | A1* | 5/2014 | Mallookis et al. | 135/145 |

* cited by examiner

Prior Art

TENT WITH A REINFORCED FRAME-SUPPORTING STRUCTURE

BACKGROUND OF THE INVENTION

1. Technical Field

The present utility model relates to the technical field of tents, and more specifically, to a tent with a reinforced frame-supporting structure.

2. Description of Related Art

At present, tents have become indispensable outdoor goods, and for the convenience of carrying and storage, are usually designed to have a folding frame structure. They are often folded and spread by the hinged connection between the beam and the foot bar.

Common folding tents are easy to use because their folding frame structure as shown in FIG. 1 allows folding and unfolding. But the hinges are likely to be broken or bent, particularly in rainy days when the central portion of the triangular inclined planes of the tent's top fabric tends to sag and accumulate water and finally causes the tent to fall down, so such tents have a short service life.

BRIEF SUMMARY OF THE INVENTION

The technical problem to be solved by the present utility model is to provide a reinforced-frame structure, increased-hinge stability and inclined plane water accumulation preventing tent with a reinforced frame-supporting structure.

To solve the above technical problem, the technical solution of the present utility model is as below: comprising a top disc, a plurality of vertex angle support bars whose tops are circumferentially and obliquely connected with the top disc, foot bar supports connected with the bottom of each vertex angle support bar, hinged beams arranged between two vertex angle support bars, wherein either end of the hinged beams is connected with the upper end of two adjacent foot bar supports respectively, a frame-reinforcing support bar is provided between the hinged beam and the top disc whose top is obliquely connected with the top disc and bottom is connected with the middle hinged portion of the hinged beam.

The frame-reinforcing support bar is a telescopic support bar which consists of two or more hollow tubes having a progressively reducing diameter and capable of sliding into one another in succession and sliding with respect to one another.

A reinforcing bar is provided between the vertex angle support bar and the foot bar support, whose top is connected with the lower end of the vertex angle support bar and bottom is connected with the upper end of the foot bar support.

In the tent with a reinforced frame-supporting structure according to the present utility model, a frame-reinforcing support bar is provided between the hinged beam and the top disc, with the bottom of the frame-reinforcing support bar connected with the middle hinged portion of the hinged beam, so that once the tent is opened, the middle hinged portion of the hinged beam is supported and therefore will not bend outward or inward, thus forming a firm anti-bending structure and reinforcing the weakest location. In addition, the top of the frame-reinforcing support bar is obliquely connected with the top disc, giving direct support to the central portion of the triangular inclined planes at the tent's top where sagging and water accumulation often arise. In addition, the present utility model has a compact and reasonable structure featuring neatness and simplicity as a whole.

Furthermore, the frame-reinforcing support bar is a telescopic support bar which consists of two or more hollow tubes having a progressively reducing diameter and capable of sliding into one another in succession and sliding with respect to one another. Use of a telescopic support bar as the frame-reinforcing support bar facilitates the fold-up of the tent's frame structure and enables the frame structure to have a smaller fold-up volume.

Furthermore, a reinforcing bar is provided between the vertex angle support bar and the foot bar support bar whose top is connected with the lower end of the vertex angle support bar and the bottom is connected with the upper end of the vertex angle support bar, thus reinforcing the tent's overall frame structure and increasing the stability.

Figure 1:
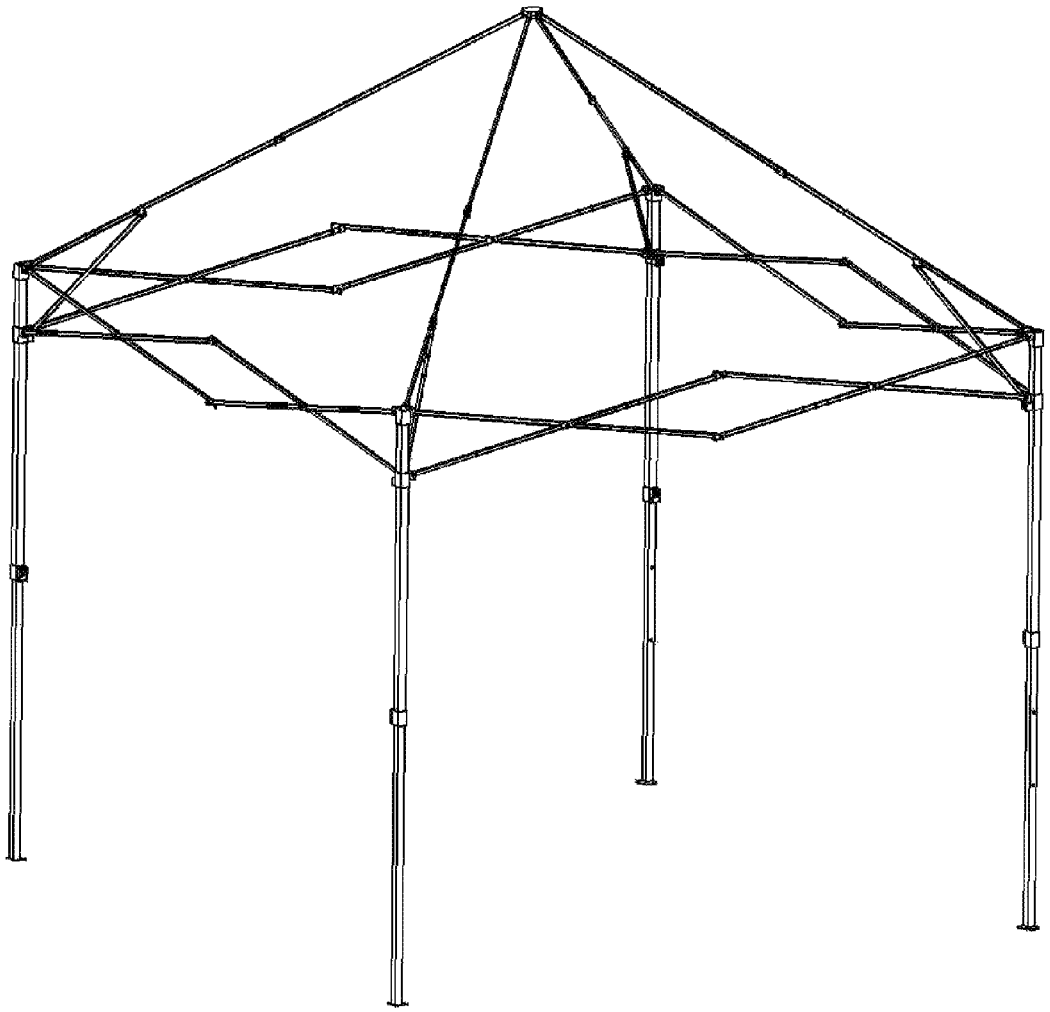
FIG. 1 is a schematic view of the structure of a tent in the prior art.
Figure 2:
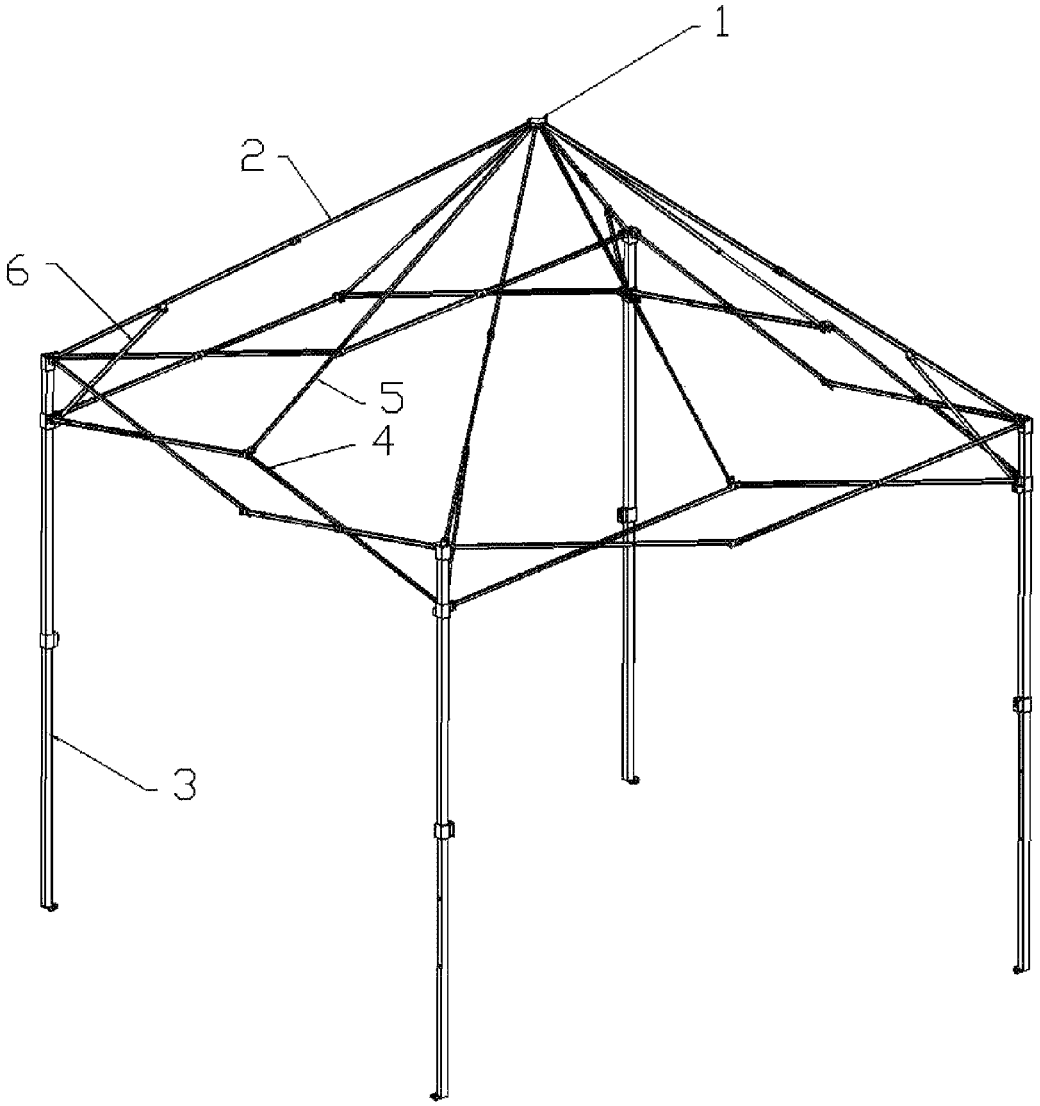
FIG. 2 is a schematic view of the structure of the tent with a reinforced frame-supporting structure according to the present utility model.
Figure 3:
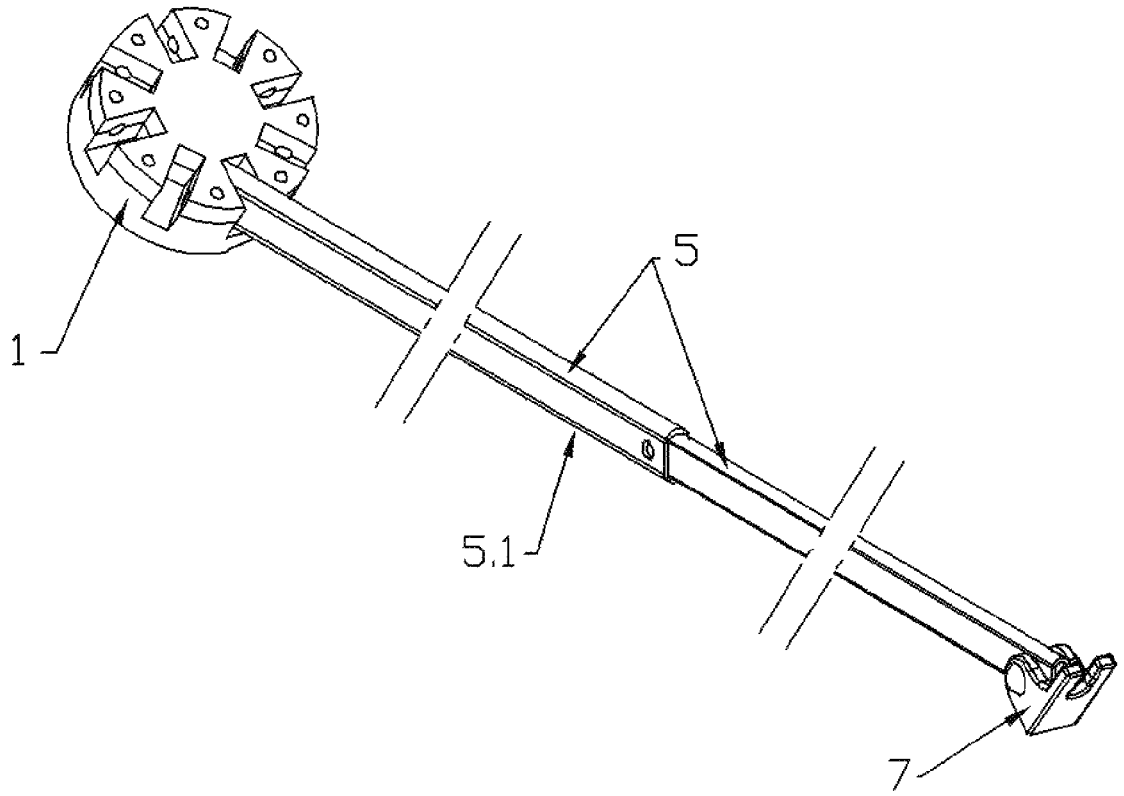
FIG. 3 is a schematic view illustrating the assembly of the frame reinforcing support bar, top disc and snaps of the tent with a reinforced frame-supporting structure according to the present utility model.

Reference numerals of major components in the present utility model: 1 top disc, 2 vertex angle support bar, 3 foot bar support, 4 hinged beam, 5 frame reinforcing support bar, 5.1 hollow tube, 6 reinforcing bar, 7 snap.

DETAILED DESCRIPTION OF THE INVENTION

The present utility model will be further described in detail hereinafter in combination with the drawings.

As shown in the drawings, the tent with a reinforced frame-supporting structure according to the present utility model comprises a top disc 1, a plurality of vertex angle support bars 2 whose tops are circumferentially and obliquely connected with the top disc 1, foot bar supports 3 connected with the bottom of each vertex angle support bar 2. In the embodiment, the number of the vertex angle support bar 2 is four; the four vertex angle support bars 2 are arranged along the circumference of the top disc 1, and each vertex angle support bar 2 forms an included angle with the top disc 1, i.e. the vertex angle support bar 2 is oblique.

Between two adjacent vertex angle support bars 2 are provided with a hinged beam 4 whose either end is connected with the upper end of the foot bar support 3, wherein the hinged-beam 4 formed by joining two beam bars with hinges is commonly known as a hinged-beam.

A frame-reinforcing support bar 5 is provided between the hinged beam 4 and the top disc 1, the top of the frame-reinforcing support bar 5 is obliquely connected with the top disc 1 and the bottom of the frame-reinforcing support bar 5 is connected with the middle hinged portion of the hinged beam 4, wherein the oblique connection means leaving an included angle between the frame-reinforcing support bar 5 and the top disc 1, i.e. the frame-reinforcing support bar 5 is secured to the top disc 1. The connection between the bottom of the frame-reinforcing support bar 5 and the middle hinged portion of the hinged beam 4 is realized by the provision of a snap 7 at the bottom of the frame-reinforcing support bar 5. The bottom of the frame-reinforcing support bar 5 is connected to the middle hinged portion of the hinged beam by the snap 7, and the snap 7 can be removed from the middle hinged portion of the hinged beam so as to fold up the tent. Apart from the snap 7, a hook structure can also be used for realizing the connection with the middle hinged part of the hinged beam.

As an improved solution of the embodiment, the frame-reinforcing support bar 5 is preferably a telescopic support bar which consists of two or more hollow tubes 5.1 having a progressively reducing diameter and capable of sliding into one another in succession and sliding with respect to one another. In the embodiment, the number of the hollow tube 5.1 is two, and the two tubes are capable of sliding with respect to one another and secured by means of jumping beads inside. The telescopic support bar is commercially available and has a common telescopic bar structure.

In addition, a reinforcing bar 6 is provided between the vertex angle support bar 2 and the foot bar support 3, whose top is connected with the lower end of the vertex angle support bar 2 and bottom is connected with the upper end of the foot bar support 3.

Once the tent is opened, the telescopic support bar whose top is connected with the top disc is stretched out until the jumping beads are ejected and securing is realized, and now the bottom of the telescopic support bar stretched out is connected to the middle hinged portion of the hinged beam through the snap 7, making the middle of the hinges supported so as not to bend outward or inward, therefore a stable anti-bending structure is formed, strengthening the weakest location of such tents and increasing the product's firmness and stability. Besides, being arranged between the top disc and the middle of the hinged beam, the telescopic support bar provides direct support for the central portion of the tent's triangular inclined planes where sagging and water accumulation often arise so as not allow it to accumulate water and achieve the effect of preventing water accumulation. To fold up the tent, it is sufficient to eject the snap 7 from the connection portion of the hinges and retract the telescopic supporting bar, and then the whole tent can be folded up according to the usual steps.

What is claimed is:

1. A tent with a reinforced frame-supporting structure, comprising:

a top disc (1), a plurality of vertex angle support bars (2), all of whose top ends are directly, circumferentially and obliquely connected with the top disc (1), foot bar supports (3) connected with the bottom end of each vertex angle support bar (2), hinged beams (4) arranged between two directly adjacent vertex angle support bars (2), wherein either end of the hinged beams (4) is connected with the upper end of adjacent foot bar supports (3) respectively, characterized in that a plurality of frame-reinforcing support bars (5) are provided between the hinged beams (4) and the top disc (1), all of the top ends of the frame-reinforcing support bars (5) are directly, circumferentially and obliquely connected with the top disc (1) and the bottom ends of the frame-reinforcing support bars (5) are connected with a middle hinged portion of the hinged beams (4).

2. The tent with a reinforced frame-supporting structure as claimed in claim 1, characterized in that the frame-reinforcing support bar (5) is a telescopic support bar which consists of two or more hollow tubes (5.1) having a progressively reducing diameter and capable of sliding into one another in succession and sliding with respect to one another.

3. The tent with a reinforced frame-supporting structure as claimed in claim 1, characterized in that a reinforcing bar (6) is provided between a vertex angle support bar (2) and a foot bar support (3), whose top end is connected with a hinge on the lower end of the vertex angle support bar (2) and whose bottom end is connected with the upper end of the foot bar support (3).

* * * * *